US007900270B2

(12) United States Patent
Scheffer

(10) Patent No.: US 7,900,270 B2
(45) Date of Patent: Mar. 8, 2011

(54) SHIN GUARD

(75) Inventor: Harald Scheffer, Merzig (DE)

(73) Assignee: S1Sport International Limited (CY)

( * ) Notice: Subject to any disclaimer, the term of this patent is extended or adjusted under 35 U.S.C. 154(b) by 23 days.

(21) Appl. No.: 11/989,986

(22) PCT Filed: Jul. 17, 2006

(86) PCT No.: PCT/EP2006/007005
§ 371 (c)(1),
(2), (4) Date: Feb. 4, 2008

(87) PCT Pub. No.: WO2007/014641
PCT Pub. Date: Feb. 8, 2007

(65) Prior Publication Data

US 2009/0077707 A1 Mar. 26, 2009

(30) Foreign Application Priority Data

Aug. 2, 2005 (DE) ..... 10 2005 036 170

(51) Int. Cl.
*A41D 13/00* (2006.01)

(52) U.S. Cl. ..... 2/22

(58) Field of Classification Search ..... 128/881, 128/882; 602/23, 25, 26, 62, 63; 2/22, 24, 2/16, 911, 62, 242, 44, 45
See application file for complete search history.

(56) References Cited

U.S. PATENT DOCUMENTS

| | | | | |
|---|---|---|---|---|
| 4,001,953 | A * | 1/1977 | Fugere et al. | 36/2 R |
| 4,306,315 | A * | 12/1981 | Castiglia | 2/22 |
| 4,926,501 | A * | 5/1990 | Goosen | 2/22 |
| 5,450,625 | A * | 9/1995 | Hu | 2/16 |
| 6,029,273 | A * | 2/2000 | McCrane | 2/24 |
| 6,105,164 | A * | 8/2000 | Huang | 2/22 |
| 6,131,195 | A | 10/2000 | Foreman | |
| 6,226,796 | B1 * | 5/2001 | Tollini | 2/22 |
| 6,402,712 | B1 * | 6/2002 | Gauvry | 602/26 |
| 2002/0184693 | A1 | 12/2002 | Beland | |
| 2003/0167548 | A1 | 9/2003 | LaShoto | |

FOREIGN PATENT DOCUMENTS

DE 94 07 629 U1 7/1994

* cited by examiner

*Primary Examiner* — Tejash Patel
(74) *Attorney, Agent, or Firm* — Renner, Kenner, Greive, Bobak, Taylor & Weber

(57) ABSTRACT

The invention relates to a shin guard, in particular for footballers, having a stiff shield element (3) arranged in front of the shin, and having means of fastening the shield element (3) on the lower leg (1). According to the invention, the fastening means have a strapping device (2) running around the lower leg (1), and the shield element (3) is connected to the strapping device (2) over much of its inner surface (18), which is directed towards the shin.

9 Claims, 2 Drawing Sheets

SHIN GUARD

FIELD OF INVENTION

The invention concerns a shin guard, in particular for soccer players, having a rigid shield element arranged in front of the shin, and having means of fastening the shield element on the lower leg.

BACKGROUND OF THE INVENTION

The fastening means on conventional shin guards for soccer players comprise flaps whose ends can be joined together at the back of the lower leg, and whose other ends are attached to the shield element at the latter's edge. Forces acting on the shield are transmitted in their entirety to the flaps via the joints, which causes not only the flaps, but also the shield element to slip slightly during play and is extremely unpleasant for the player.

BRIEF SUMMARY OF THE INVENTION

The present invention is based on the problem of creating a new shin guard of the kind mentioned above, which ensures a more stable positioning of the shield element on the shin.

According to the present invention, this problem is solved by a shin guard that is characterized in that the fastening attachments include a bandage adapted at least partially to surround a user's lower leg, and in that the shield element forms a connection with the bandage over a substantial part of the shield element's inner surface that faces the shin.

As a result of the connection which, in accordance with the present invention, may cover a large area of. e.g., more than 50% of the inner surface between the bandage and the shield element, the forces acting on the shield element are distributed over the shield element such that the static frictional force between the bandage and the lower leg is not exceeded. Therefore, under normal circumstances, it is hardly possible for the bandage and consequently the shield element to slip.

Preferably, the shield element is detachable from the bandage. A Velcro® hook and eye fabric fastener in particular is considered suitable for the detachable connection.

Advantageously, the bandage comprises an elastic material, in particular a textile material, which feels pleasant on the skin when worn. The elasticity of the material advantageously enables a desired gripping force to be adjusted in a stable and reproducible manner.

In a preferred embodiments the bandage can only be wrapped around the lower leg once, and overlapping ends can be joined together, preferably by way of a Velcro® hook and eye fabric fastener. By choosing the appropriate extent of overlap of the flap ends, the Velcro® fastener advantageously offers sufficient variability for adjustment of the desired gripping force of the bandage.

The bandage preferably extends upwards to near the hollow of the knee, and downwards to near the ankle. In this way, the entire length of the lower leg is used to achieve a stable seat for the bandage and, consequently, the shield element.

The shield element preferably ends above the lower end of the bandage. The part of the bandage that protrudes downwards beyond the end of the shield element provides additional stability to the seating of the bandage on the lower leg.

In a particularly preferred embodiment of the invention, the bandage has an opening that leaves the calf free.

Advantageously, the lengths of the connection areas remaining above and below the opening, and which surround the lower leg, are measured and positioned in such a way that they lie above and below the area in which the cross-section of the lower leg varies as a result of calf muscle activity. Consequently, the shin guard in no way impedes leg movement.

In a further elaboration of the invention, the bandage could possess a flap that extends downwards and can preferably be wrapped around the sole of the foot to form a padded ankle protector.

BRIEF DESCRIPTION OF THE DRAWINGS

The invention is explained in more detail below by means of examples and the enclosed drawings relating to these examples. The drawings show that.

DETAILED DESCRIPTION OF A PREFERRED EMBODIMENT

Figure 2:
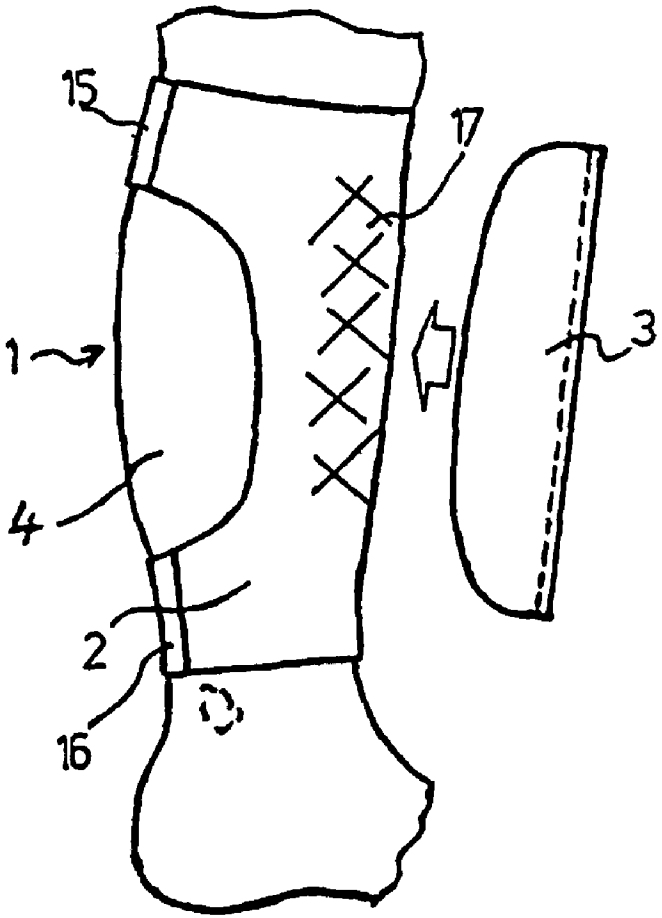
FIG. 2 is the shin guard of FIG. 1 on a lower leg, with the shield element removed.

A shin guard for a soccer player, which is to be worn under the player's socks, has a bandage (2) that can be attached to the lower leg (1) and combined by way of a Velcro® hook and eye fabric fastener with a rigid shield element (3) that is intended to be positioned in front of the shin.

The bandage (2), manufactured from an elastic textile material, possesses an opening (5) that leaves the calf (4) largely uncovered. The connecting sections (6) and (7) remaining above and below the opening each extend across an area of the lower leg in which changes to the cross-section of the lower leg as a result of calf-muscle activity are minimal.

Figure 1:
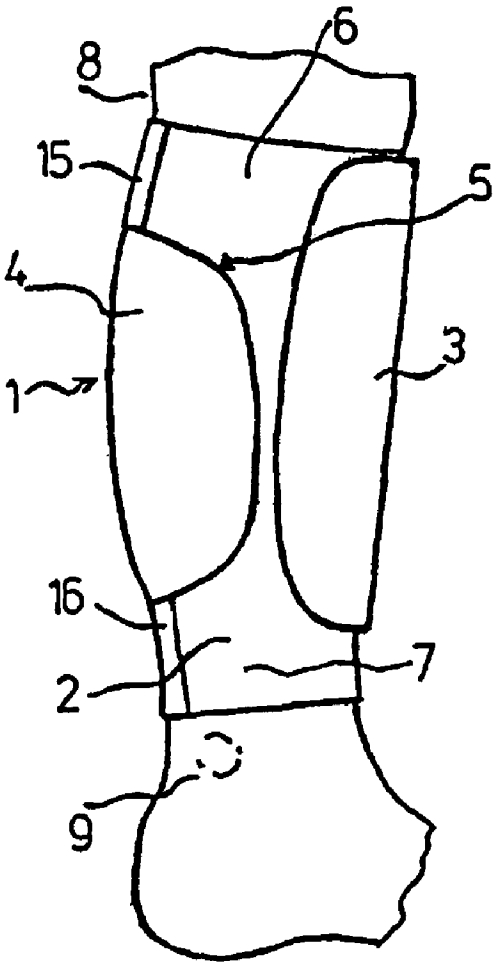
FIG. 1 is a side view of an inventive shin guard connected with a lower leg.

As can be seen in FIG. 1, the bandage (2) extends upwards to near the hollow of the knee (8), and downwards to near the ankle (9).

In accordance with FIG. 3*a*, which shows the bandage (2) detached from the lower leg and spread out in one plane, the connecting section (6) comprises the flaps (11) and (12), and the connecting section (7), the flaps (13) and (14). At each of the flap ends a fastening area (10) is provided to form a Velcro® hook and eye fabric fastener (15) and (16).

A fastening surface (17) on the bandage (2) and a fastening surface (18) that extends over the entire inner surface (23) of the shield element (3) in the embodiment shown, together form the abovementioned Velcro® fastener.

Figure 3:
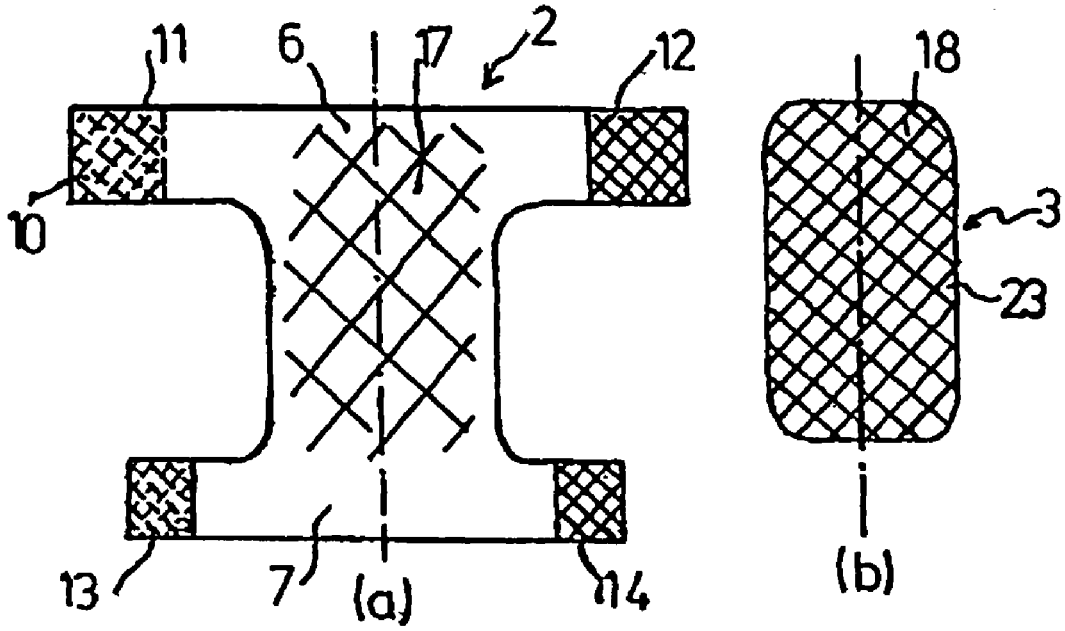
FIG. 3 is the shin guard of FIG. 1 disassembled into its individual parts and detached from the lower leg.

The shin guard shown in FIG. 1 to FIG. 3 can be comfortably applied without having to take off the player's shoes or knee-length socks. The bandage (2) can be applied to the lower leg with knee-length socks merely rolled down, and the Velcro® fasteners (15) and (16) then being closed. Finally the shield element (3) can be attached, the fastening surface (18) extending over the entire inner surface (23) and engaging the fastening surface (17) on the bandage (2).

The shin guard is comfortable to wear. Thanks to the opening (5), the activity of the calf muscle, and thus leg movement as a whole, is not impeded.

The connection extending over the entire inner surface (23) of the shield element (3) between the shield element (3) and the bandage (2) on the one hand, and the bandage (2) with a correspondingly large surface lying adjacent to the lower leg on the other, ensures that the shield element (3) remains in the desired position in front of the shin, and does not slip laterally or vertically. Advantageously, when detached from the shield element (3), the bandage (2) can be washed like an item of clothing. Each shield element (3) can be used together with different bandages.

Should the shield element (3) still slip, it can be easily returned to the desired place by rolling down the sock covering it, opening the Velcro® fasteners (15) and (16) and closing them again when the position of the shield element (3) has been corrected. Where necessary, the bandage (2) can also be twisted without opening the Velcro® fasteners.

Figure 4:
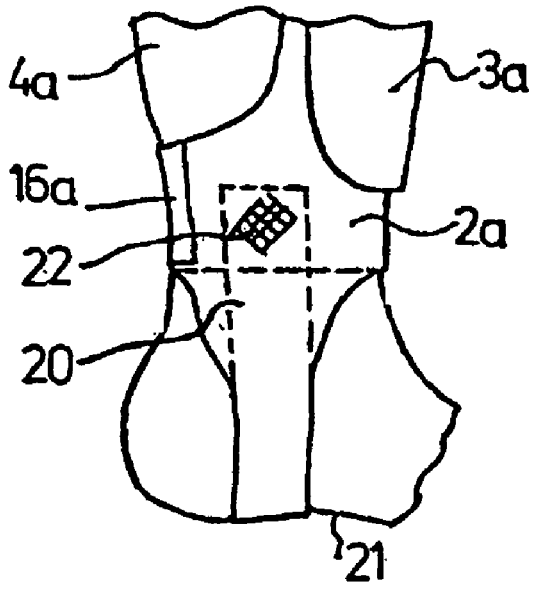
FIG. 4 is a partial illustration of a shin guard according to a second embodiment of the invention.

The embodiment of a shin guard shown in FIG. 4 differs from the previous design example in that a flap (19) is attached to a lower fastening section (7*a*), The flap (19) is padded in the area of the ankle at (20), thus forming an ankle protector. The end of the flap wrapped around the sole of the foot (21) can be attached to the bandage (2*a*) at (22) using a Velcro® fastener.

The invention claimed is:

1. A shin guard comprising:

a rigid shield element for positioning in front of a user's shin, and having a fastening surface provided over a substantial part of an inner surface of the shield element, said inner surface facing said user's shin; and a bandage which at least partially surrounds a user's lower leg, for fastening the rigid shield element thereon, and having:

a fastening surface which co-operates with the fastening surface provided on the shield element thereby to form a detachable connection between the shield element and the bandage over a substantial part of the inner surface of the shield element facing the user's shin, such that the forces acting on the shield element are distributed over the shield element such that the static frictional force between the bandage and the lower leg is not exceeded;

an opening for leaving said user's calf free so as not to impede activity of said user's calf muscle; and connection areas for surrounding said user's lower leg, said connection areas being located above and below the opening, and being positioned so near to the user's knee and ankle, and being of such a length, so as not to impede activity of the user's calf muscle.

2. The shin guard as claimed in claim 1, wherein the bandage is wrapped at least partially around the user's lower leg so as to attach to the lower leg, such that opposed ends of the connection areas of the bandage are arranged to be joined together.

3. The shin guard as claimed in claim 2, wherein the opposed ends of the bandage are joined together by way of a hook and loop fastener material.

4. The shin guard as claimed in claim 1, wherein the rigid shield element is detachably connected with the bandage by way of a hook and loop fastener material.

5. The shin guard as claimed in claim 1, wherein the bandage is formed of an elasticated material.

6. The shin guard as claimed in claim 5, wherein the bandage is formed of a textile material.

7. The shin guard as claimed in claim 1, wherein the shield element terminates above a lower end of the bandage.

8. The shin guard as claimed in claim 1, wherein the bandage comprises a flap which wraps around the sole of the user's foot so as to form a padded ankle protector.

9. A bandage for a shin guard having a shield element for positioning in front of a user's shin, said bandage including a fastening surface for forming a detachable connection between the shield element and the bandage over a substantial part of the inner surface of the shield element facing the user's shin, such that the forces acting on the shield element are distributed over the shield element such that the static frictional force between the bandage and the lower leg is not exceeded, and wherein said bandage includes an opening to leave said user's calf free, and connection areas above and below said opening, said connection areas at least partially surrounding said user's leg, and being positioned so near to the user's knee and ankle, and of such a length, so as not to impede activity of the user's calf muscle.

* * * * *